United States Patent [19]

Garcia

[11] Patent Number: 4,498,262

[45] Date of Patent: Feb. 12, 1985

[54] SOLAR SHIELD ASSEMBLY

[75] Inventor: Enrique Garcia, San Juan, P.R.

[73] Assignee: Enrique Garcia Associates, San Juan, P.R.

[21] Appl. No.: 223,341

[22] Filed: Apr. 6, 1981

[51] Int. Cl.[3] ..... E04H 14/00; E04H 9/00; E04D 13/16

[52] U.S. Cl. ..... 52/173 R; 52/3; 52/24; 52/25; 52/74; 52/78; 52/91; 52/202; 126/418

[58] Field of Search ..... 52/3, 5, 22, 74, 78, 52/202, 630, DIG. 16, 261, 83, 24–26, 91; 47/26; 126/418, DIG. 1; 165/45, 47, 49

[56] References Cited

U.S. PATENT DOCUMENTS

| | | | |
|---|---|---|---|
| 2,201,320 | 5/1940 | Place | 52/25 |
| 2,270,537 | 1/1942 | Ludington | 52/24 |
| 2,476,135 | 7/1949 | Colburn | 52/91 X |
| 2,602,406 | 7/1952 | Orter | 52/3 |
| 2,620,651 | 12/1952 | Brauer | 52/91 X |
| 2,690,072 | 9/1954 | Reed | 52/91 X |
| 2,731,927 | 1/1956 | McCain | 52/83 |
| 2,894,296 | 7/1959 | Scoccia | 52/78 X |
| 3,043,112 | 7/1962 | Head | 165/49 X |
| 3,129,793 | 4/1964 | Ferrell | 52/202 X |
| 3,381,424 | 5/1968 | Butler | 52/5 X |
| 3,791,089 | 2/1974 | Alderman | 52/484 |
| 4,099,344 | 7/1978 | Ruemeli | 47/26 |
| 4,193,234 | 3/1980 | Wong | 52/173 R |

OTHER PUBLICATIONS

Sweet's Catalog, 1977, v. 3, 7.4/La, p. 7 and 1977, v. 3, 7.4/GL, p. 4.

Architectural Record, Aug. 1961, pp. 145–147.

*Primary Examiner*—Alfred C. Perham

*Attorney, Agent, or Firm*—Kane, Dalsimer, Kane, Sullivan and Kurucz

[57] ABSTRACT

An assembly for shielding a concrete structure from solar radiation comprising a plurality of heat-reflective, heat-insulative panels suspended above the surface of the concrete. The surface of the panels proximal to the concrete surface is non-planar.

7 Claims, 2 Drawing Figures

SOLAR SHIELD ASSEMBLY

BACKGROUND OF THE INVENTION

1. Field of the Invention

The invention relates to methods and assemblies for controlling the impingement of solar radiation on building structures and more particularly relates to methods and apparatus for the reduction of heat gain by concrete structures exposed to direct solar radiation.

2. Brief Description of the Prior Art

Concrete building structures are found throughout the world. They have found particular favor in tropical and semitropical zones because of their resistance to rot, corrosion and deformation under relatively humid conditions. However, concrete structures are not without their own particular problems of maintenance and use. For example, concrete structures are ideal heat sinks, with the ability to absorb about 230 BTU per hour from solar radiation. If the concrete is dark in color, absorption of solar radiation is further enhanced. In humid climates, concrete is a substrate which favors the growth of certain bacteria and molds which are dark in color. As these bacteria and molds proliferate, the affect is a darkening of the concrete surface so that absorption of solar radiation is further favored over a period of time.

Concrete is also a conductor of thermal energy and will freely radiate absorbed thermal energy. Thus, during exposure to the sun, concrete absorbs thermal energy in large quantities. When the day is ended, the concrete radiates the absorbed energy to the surrounding environment. As one practical example of the affect of this absorption/radiation cycle one might cite the situation found in Puerto Rico where many residences are concrete structures. During the daylight hours, exposed concrete, acting as a heat-sink, may absorb thermal energy from solar radiation to the extent that the concrete reaches temperatures of from 130° F. to 150° F. This thermal energy is transmitted to both inner and outer wall surfaces of the concrete structure and radiated to both the inside and outside of the building. After the sun has set in the sky, radiation will continue through the night. Often the temperatures inside the building will be uncomfortable for residents until the early morning hours, unless air conditioning is employed.

Also, in Puerto Rico and like areas with similar climates, rainfall is experienced on a daily or near daily basis. As these cool rains strike hot concrete, the resulting cooling effect is so sudden that the concrete may crack under the stress of thermal shock. This of course requires additional maintenance activity if the building is to be maintained properly.

By the method of my invention, employing the assembly of the invention, the above-described problems may be resolved. Concrete structures, particularly roofs exposed to direct sunlight are shielded and protected from solar radiation with its consequences. The assembly of the invention may be considered a passive type of cooling system for concrete structures that require little maintenance, having no moving parts, valves etc. and no power (energy) requirements for operation. The assembly is simple to construct.

SUMMARY OF THE INVENTION

The invention comprises an assembly for shielding a concrete structure from solar radiation, which comprises:

a plurality of heat reflective, heat insulative, panels suspended in a position between the source of solar radiation and the surface of a concrete structure, the surface of said panel proximal to the concrete structure being non-planar;

means attached to said panels for suspending them; and said panels being spaced from each other and the concrete surface.

The invention also comprises the method of shielding concrete structures from solar radiation by suspending the assembly of the invention immediately between the structure surface and the source of radiation, i.e.; without any intervening structure. The invention also comprises a method of maintaining temperatures in a concrete building structure exposed to solar radiation. The method comprises installing an assembly of the invention immediately between the surface of the concrete structure and the source of solar radiation so as to shade the concrete structure. The method and assembly of the invention do not entrap or ventilate air within the concrete structure and thereby does not create drafts or stagnant air pockets. As a cooling system, the assembly of the invention is completely passive and requires no energy for operation.

The method and assembly of the invention are useful to protect concrete structures from thermal damage and to reduce energy requirements for conventional air-conditioning of the interior of such structures. The method is particularly useful for protection of concrete roof structures.

The term "concrete" as used throughout the specification and claims means a synthetic building material molded in a plastic condition and then caused or allowed to harden or coalesce into a solid mass. Representative of concrete are hardened or set hydraulic cements. Hydraulic cements are generally well-known in the art and include any cement containing compositions which are formed by combination with water and set or cured to a hard mass. The cement may be any compound or mixture of compounds (usually calcareous or argillaceous) which interact with water to form a cohesive, solid product. Representative of such cements are Gypsum, limes including hydraulic lime, Pozzolan, natural cement, Portland cement, magnesite cement, aluminous cement, slag cement and the like. Concrete may also contain filler materials such as gravel, sand, cinders, slag and like fillers which are conventionally termed "aggregate". The aggregate is encapsulated in a matrix of cement and when the mixture is combined in conventionally employed proportions with water, there is initially formed a slurry which may be molded. After deposit in a mold the slurry sets or cures due to complex chemical reactions to form a hard, solid, unified mass referred to as concrete. In addition to aggregate, other conventionally employed ingredients may be present in the concrete. Illustrative of such additional ingredients are reinforcing filler such as fibrous material exemplified by fibers of glass, steel, nylon and the like, animal hair, spun fibers and like materials.

DETAILED DESCRIPTION OF THE PREFERRED EMBODIMENTS OF THE INVENTION

Figure 1:
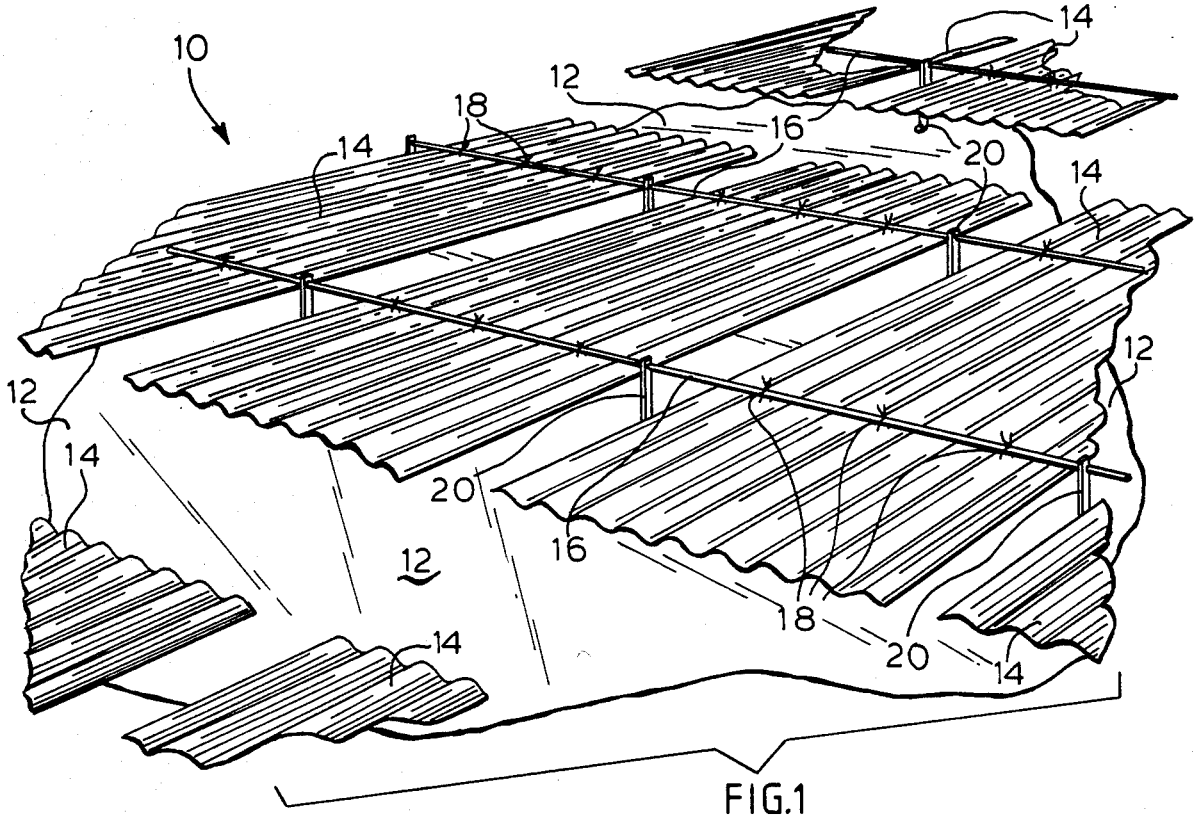
FIG. 1 is a view-in-perspective of an embodiment assembly of the invention placed to shield a flat concrete roof.
Figure 2:
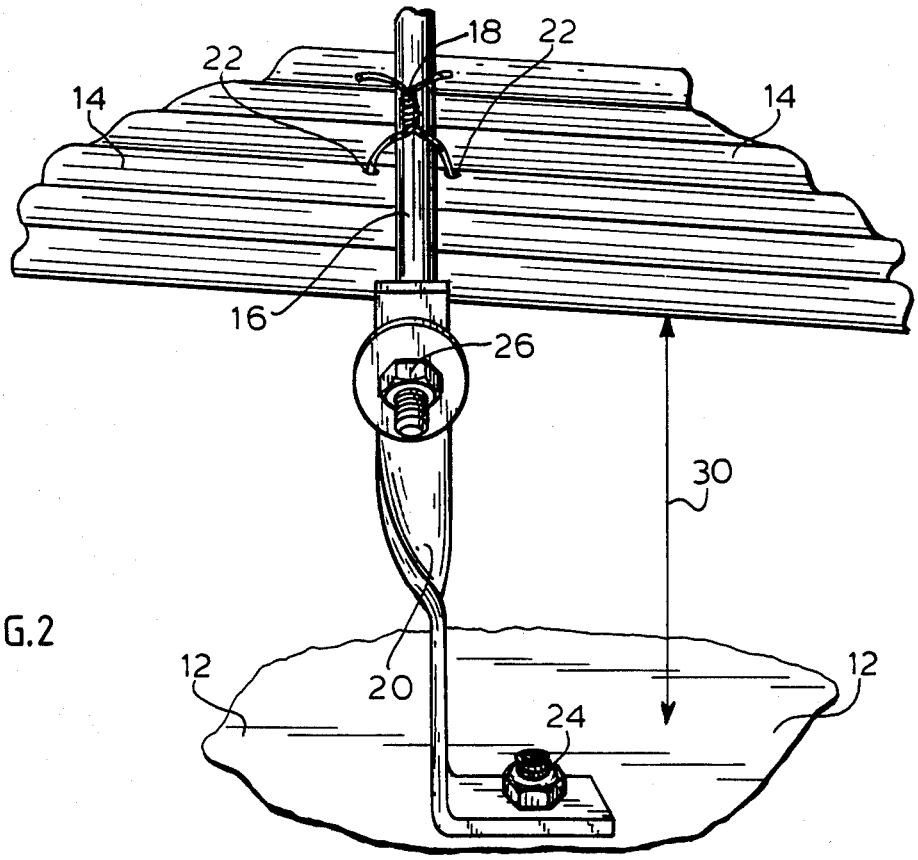
FIG. 2 is a view-in-perspective of the means of suspending the embodiment assembly of FIG. 1.

Those skilled in the art will appreciate the invention from the accompanying drawings of FIGS. 1 and 2 when viewed in conjunction with the following description.

FIG. 1 is a view-in-perspective of an embodiment assembly 10 of the invention placed to shield a flat, concrete (cementitious) roof 12 from solar radiation. The assembly comprises a plurality of heat reflective, heat insulative panels 14, each of which is suspended so that the lower surface of the panel 14 is a distance of from about 1.5 inches to about 10 inches, preferably 3 to 6 inches, above the surface of the concrete roof 12, creating space 30 (see FIG. 2). At lower levels of suspension, the assembly is essentially ineffective in its purpose and at higher levels, less efficient.

Each panel 14 in the embodiment assembly 10 is a corrugated sheet of galvanized iron. However, any conventional heat reflective, heat insulative material may be used such as other metals, synthetic polymeric resins, fiberglass, perlite and like materials. The term "heat reflective" as used herein means thermal energy from solar radiation is substantially reflected and only small proportions are permitted to penetrate or be absorbed by the body of the panel 14. Panels 14 may be made of non-heat reflective materials, provided they are faced with a heat reflective material. For example, a panel 14 made of extruded polymeric resin may be used, faced with aluminum foil or the like to reflect the thermal energy in solar radiations.

The term "heat insulative" as used herein means that the panel 14 prevents passage of substantial proportions of thermal energy through the panel at least by reflection and possibly by absorption and containment of some portion of the energy from solar radiations.

The panels 14 are corrugated sheets. Corrugated sheets are preferred since they provide rigidity to the panel 14. The upper surface need not be corrugated and may be flat or of any other configuration. However it is essential to the invention that the lower surface of the panel 14 be non-planar, preferably corrugated. If the lower surface of the panel 13 were planar, it would redirect thermal energy, radiated from the panel 14 to the surface of roof 12. Being of a non-planar configuration, there is a diffusion of radiated thermal energy in different directions with a net result that there is less transmission of thermal energy to the underlying roof 12 structure.

As shown in the FIG. 1, the panels 14 are mounted above roof 12 on an angle to the horizontal, i.e.; pitched to allow run-off of precipitation. The means of mounting or suspension is not critical to the invention, but the assembly 10 illustrates a preferred embodiment means. A support bar 16, supported at each end by a support leg 20 traverses the upper surface of the panel 14 and acts as a means of suspending the panel 14 above the surface of roof 12. The bar 16, positioned above panel 14, prevents sailing, i.e.; upward movement of the panel 14 as air or wind flows in the space 30 between panel 14 and roof 12. The suspension of the panel 14 from bar 16 is affected in the assembly 10 by a loose connection with wire 18 inserted through the holes 22 in panel 14. This loose suspension means is preferred in the embodiment assembly 10 since a rigid holding of the panel 14 to bar 16 is undesirable. A rigid mounting would prevent the expansion and contraction of the assembly 10 components subjected to solar radiation and cooling. Placement of the bar 16 above panel 14 prevents sailing, i.e.; uplift of the panel in heavy winds, i.e.; even 100 mile/-hour hurricane winds. Although not shown in the drawings, one may insert a supporting backplate under the panel 14 in the vicinity of holes 22, to strengthen the connection against shearing of wire 18 when the panel 14 is exposed to down wind pressures.

Referring now to FIG. 2, a view-in-perspective of the means of suspending the embodiment assembly of FIG. 1, one can see in greater detail the attachment means between bar 16 and panel 14 affected by the loose connection with wire 22. The leg strap 20 is secured to the concrete roof 12 through bolt 24. The leg 20 is attached to the bar 16, which has a threaded end, with nut 26. This is the preferred method of suspending and securing the panels 14 a given distance above the roof 12. As shown in FIG. 1, there are no obstructing structures between panels 14 and the source of solar radiation or between panels 14 and roof 12.

Referring again to FIG. 1, one would note that the individual panels 14 are spaced apart from each other so that space 30 around the periphery of the panels 14 is completely open. This is a necessity for maximum and optimum cooling effects on the solar shield assembly 10. Even slight breezes, i.e.; of a velocity of from 1 to 5 miles per hour are thereby permitted to circulate in the spaces between and beneath panels 14 to aid in cooling the surface of the concrete roof 12. In the absence of a breeze, heated air in space 30 beneath the panel 14 will escape by a convection flow through the spaces between the panels 14. Preferably, the open spaces around the periphery of each of the panels 14 are substantially uniform and in total account for an area of about 10 to about 20 percent of the concrete roof area to be shielded. There is a further advantage to the spacing of the panels 14 from each other. As described previously, in the tropical and semi-tropical areas, daily rainfall is not unexpected. It should be borne in mind that the purpose of the shield assembly 10 is not to protect the roof structure from rain. When this rainfall, warmed by contact with panels 14, runs off the inclined panels 14, it eventually covers the surface of the concrete roof 12. With the open areas around the panels 14, evaporation of the accumulated precipitation following cessation of rainfall is more rapid and further enhances cooling of the surface of roof 12. This evaporation is controlled to some degree in comparison to an open roof structure and is retarded. The slower evaporation rate serves for a more efficient cooling of the surface of the roof 12 over a longer period of time.

The following example describes the manner and process of making and using the invention and sets forth the best mode contemplated by the inventor for carrying out the invention but is not to be construed as limiting.

EXAMPLE

Following the general description given above, a plurality of corrugated metal sheets (12 gauge galvanized iron; 8'-0"×2'-5" in size) were suspended on an angle to the horizontal, above the concrete roof of a building in Puerto Rico. The distance between each of the sheets and the concrete roof measured 9" at the highest end and 6" at the lowest end along the length of the sheet. Each sheet was spaced from neighboring sheets a distance of 2" at the sides and 2' at the ends to cover the roof except for a 3' wide peripheral margin around the outer perimeter of the roof. Suspension was from a metal bar through a galvanized wire connection as shown in FIG. 2 of the drawings accompanying this specification. The assembly of suspended sheets function as a solar shield. Measurements were taken of the temperature of the roof surface in shielded and unshielded areas, during the month of December 1980 (a time when there is the least amount of solar radiation and the sun is at its lowest angle on the horizon). The measurements obtained during the period of observation are shown below. Measurements were made by a temperature probe inserted midway into the concrete roof (5" thick concrete slabs).

| Date and Conditions | Time (EST) | Temperature (°F.) Shielded | Unshielded |
|---|---|---|---|
| Dec. 2, 1980 | | | |
| | 3:00 PM | 75 | 90 |
| | 6:00 PM | 75 | 85 |
| | 9:00 PM | 75 | 80 |
| | 12:00 Midnight | 72 | 78 |
| Dec. 3, 1980 | | | |
| Clear & Sunny | 5:00 AM | 70 | 75 |
| | 7:00 AM | 70 | 75 |
| | 9:00 AM | 74 | 88 |
| | 1:00 PM | 80 | 110 |
| Brief rain shower | 3:45 PM | 80 | 115 |
| | 4:00 PM | 80 | 110 |
| | 5:00 PM | 80 | 110 |
| | 8:00 PM | 78 | 90 |
| | 12:00 Midnight | 75 | 82 |
| Dec. 4, 1980 | | | |
| | 5:00 AM | 72 | 80 |
| | 7:00 AM | 72.5 | 77.8 |
| | 9:00 AM | 75 | 89 |
| | 12:00 Noon | 81 | 100 |
| | 2:00 PM | 85 | 115 |
| | 4:00 PM | 80 | 101 |
| | 8:00 PM | 78 | 88 |
| | 12:00 Midnight | 75 | 81 |
| Dec. 5, 1980 | | | |
| Sunny | 3:00 AM | 75 | 80 |
| | 7:00 AM | 74 | 76 |

From the above table of measurements one may observe that the temperature of the concrete roof slabs, over a 24 hour period, varies by as much as 40° F. when unshielded (75° F.-115° F.) but only by as much as 10° F. (70° F.-80° F.) during the same period of time under the solar shield of the invention. Using the formula:

$$A = \Delta T \times U \times 24 \text{ Hours}$$

werein A is heat emission, ΔT represents the temperature differential and U is the overall heat transfer coefficient one can calculate the total heat absorbed and radiated by the concrete over the 24 hour period. For the unshielded concrete, the value of U is determined by the formula:

$$U = \frac{1}{R_1 + R_2 + R_3} \quad \text{(II)}$$

where $R_1$, $R_2$ and $R_3$ are the thermal resistance factors of the concrete at the upper surface, core and lower surface, respectively. Thus, for the unshielded concrete, $$U = \frac{1}{0.25 + 0.33 + 0.92} = 0.67 \text{ BTU/Ft}^2\text{/Hr 1° F.}$$

For the shielded portion of the concrete, U is determined by the formula:

$$U = \frac{1}{R_1 + R_2 + R_3 + R_4 + R_5} \quad \text{(III)}$$

wherein $R_1$, $R_2$ and $R_3$ are as defined above, $R_4$ is the thermal resistance on the upper surface of the solar shield and $R_5$ is the thermal resistance on the lower surface of the solar shield. Thus, for the shielded portion of the concrete roof, $$U = \frac{1}{0.92 + 0.33 + 0.92 + 0.25 + 0.25} = 0.37 \text{ BTU/Ft}^2\text{/HR/°F.}$$

The heat absorption and emissions for the shielded and unshielded concrete for the above example are calculated therefore to be:

Shielded:

$$A = 10° \text{ F.} \times 0.37 \text{ BTU/Ft}^2\text{/HR/°F.} \times 24 = 88.80 \text{ BTU/Ft}^2\text{/Day}$$

Unshielded:

$$A = 40° \text{ F.} \times 0.67 \text{ BTU/Ft}^2\text{/HR/°F.} \times 24 = 643.2 \text{ BTU/Ft}^2\text{/Day}$$

Thus, the solar shield of the invention as used in this example, reduces the total heat absorption and emission of the concrete slabs by 554.4 BTU/Ft²/Day.

Extrapolated to determine the difference in overall heat gained and re-radiated for a building of, say, 2,000 square feet roof area one can readily see the difference is a reduction of 1,108,800 BTU/day (2,000×554.4) if the roof is shielded by the method of the invention. The saving in air-conditioning costs may be substantial as a result of the use of the solar shield of the invention, which maintains a lower temperature within the shielded structure.

Those skilled in the art will appreciate that many modifications may be made to the above described preferred embodiment of assembly 10 without departing from the spirit and scope of the invention. For example, the panels 14 may be painted to reflect thermal energy.

What is claimed:

1. An assembly for shielding the concrete surface of a concrete building from solar radiation, which comprises;

a plurality of heat reflective, heat insulative, panels suspended in a position between the source of solar radiation and the surface of the concrete structure, the surface of said panel proximate to the concrete structure being non-planar; and means attached to said panels for suspending them;

said panels being fixedly spaced from each other and the concrete surface so as to define first open spaces between and second open spaces beneath the panels, said open spaces being in open communication with the atmosphere whereby air may freely circulate in and out of the open spaces which are unchanging in dimension.

2. The assembly of claim 1 wherein the concrete surface is a structured roof.

3. The assembly of claim 1 wherein the panels are corrugated sheets.

4. A method of shielding concrete buildings from solar radiation and maintaining the temperature within the interior of the building, which comprises; installing an assembly of claim 1 immediately between the surface of the concrete building and the source of solar radiation.

5. An assembly for shielding the concrete surface of a concrete building from solar radiation, which comprises;

a plurality of heat reflective, heat insulative, panels suspended in a position between the source of solar radiation and the surface of the concrete building, the surface of said panel proximal to the concrete building being non-planar; and means attached to said panels for suspending them;

said panels being spaced from each other and the concrete surface so as to define first open spaces between and second open spaces beneath the panels, said open spaces being in open communication with the atmosphere whereby air may freely circulate in and out of the open spaces, the spacing of the panels from the concrete surface being within the range of from about 1.5 to 10 inches.

6. An assembly for shielding the concrete surface of a concrete building from solar radiation, which comprises;

a plurality of heat reflective, heat insulative, panels suspended in a position between the source of solar radiation and the surface of the concrete building, the surface of said panel proximal to the concrete building being non-planar; and means attached to said panels for suspending them;

said panels being spaced from each other and the concrete surface so as to define first open spaces between and second open spaces beneath the panels, said open spaces being in open communication with the atmosphere whereby air may freely circulate in and out of the open spaces, said panels being spaced from each other so as to create first open spaces having an area within the range of 10 to 20 percent of the surface area of the concrete surface to be shielded.

7. An assembly for shielding the concrete surface of a concrete building from solar radiation, which comprises;

a plurality of heat reflective, heat insulative, panels suspended in a position between the source of solar radiation and the surface of the concrete building, the surface of said panel proximal to the concrete building being non-planar; and a bar extending longitudinally across the top of the panel, said bar being supported from the concrete surface by a leg and the panels being supported from the bar by a wire;

said panels being spaced from each other and the concrete surface so as to define first open spaces between and second open spaces beneath the panels, said open spaces being in open communication with the atmosphere whereby air may freely circulate in and out of the open spaces.

* * * * *

UNITED STATES PATENT AND TRADEMARK OFFICE

CERTIFICATE OF CORRECTION

PATENT NO. : 4,498,262

DATED : February 12, 1985

INVENTOR(S) : Enrique Garcia

It is certified that error appears in the above-identified patent and that said Letters Patent is hereby corrected as shown below:

Col. 3, line 51; "panel 14" should read -- panels 14 -- .

Col. 4, line 33; "effects on" should read -- effects of -- .

Col. 5, line 13; "function" should read -- functioned -- .

Col. 6, line 7 of Claim 1; "proximate" should read -- proximal -- .

Signed and Sealed this

*Second* Day of *July 1985*

[SEAL]

*Attest:*

DONALD J. QUIGG

*Attesting Officer*

*Acting Commissioner of Patents and Trademarks*